US006478056B1

(12) United States Patent
Fitzpatrick

(10) Patent No.: US 6,478,056 B1
(45) Date of Patent: Nov. 12, 2002

(54) INTEGRATED FLUID NOZZLE AND TANK CAP REMOVAL APPARATUS

(75) Inventor: Cornelius J. Fitzpatrick, Billerica, MA (US)

(73) Assignee: Scully Signal Company, Wilmington, MA (US)

( * ) Notice: Subject to any disclaimer, the term of this patent is extended or adjusted under 35 U.S.C. 154(b) by 0 days.

(21) Appl. No.: 10/005,543

(22) Filed: Dec. 3, 2001

(51) Int. Cl.[7] ..... B65B 1/04

(52) U.S. Cl. ..... 141/301; 141/DIG. 1; 141/367; 220/DIG. 33

(58) Field of Search ..... 141/286, 301, 141/302, 349, 350, DIG. 1, 367; 220/86.2, DIG. 33

(56) References Cited

U.S. PATENT DOCUMENTS 3,148,713 A * 9/1964 Jones, Jr. ..... 141/286

4,108,223 A * 8/1978 Hansel ..... 141/285

* cited by examiner

*Primary Examiner*—Steven O. Douglas
(74) *Attorney, Agent, or Firm*—Kudirka & Jobse, LLP

(57) ABSTRACT

A fluid transfer nozzle for fuel oil and other fluid products allows for the one step removal of locking caps for vertical filling pipes. The locking cap includes a detent mechanism that, under the force of gravity, engages an obstruction within an input port of the pipe, preventing its rotation and therefore its removal. The nozzle has a socket within its mouth that engages the cap to allow rotation of the cap with rotation of the nozzle. Also within the nozzle mouth is a magnetic element that generates a magnetic field to draw the detent mechanism into an unlocked position against the force of gravity. With the cap so unlocked, the nozzle may be rotated to loosen the cap and allow its removal.

26 Claims, 5 Drawing Sheets

INTEGRATED FLUID NOZZLE AND TANK CAP REMOVAL APPARATUS

FIELD OF THE INVENTION

This invention is related generally to the field of fluid tank loading and, more specifically, to apparatus for improving the safety and ease of such tank loading.

BACKGROUND OF THE INVENTION

Fuel oil used to heat buildings is generally stored in small tanks located either inside the building, outside the building or in the ground near the building. The loading of these tanks is typically done by local distributors who fill the tanks from filling trucks. The trucks are driven to a building, and a hose with a nozzle unrolled from a spool and brought to a fill pipe. Once the cap of the pipe is removed, the nozzle is inserted into the pipe, and the fluid product is transferred by pump into the fill pipe and, ultimately, into the tank.

Caps on the fill pipes typically screw onto threads on the fill pipe, and usually have an integral nut that allows a wrench to be attached to loosen a stuck cap. The wrench may be separate, or maybe integrated with the inside of the dispensing nozzle. Most commonly, caps are tightened by hand, and therefore a wrench is used only if a cap is stuck, after which the cap is removed by hand.

In response to fears that children, or other unauthorized persons, would remove the caps to oil tanks, a locking cap was developed that is described in U.S. Pat. No. 4,223,799. The cap itself is non-magnetic, but includes a vertically movable lock member that is susceptible to a magnetic force. Relying on the fact that most fill pipes are vertical, the lock member resides, under the force of gravity, in a position that prevents the rotation of the cap when mounted on the pipe. In particular, a fitting on the top of the pipe has recesses within which the lock member can fall. When the lock member resides within the recesses, rotation of the cap relative to the pipe is inhibited, thereby preventing its removal. Through the use of a magnet, the lock member is drawn up and out of the recesses of the pipe fitting. This allows the cap to be rotated and removed. A magnetic lock for the cap to the fill pipe is therefore created.

SUMMARY OF THE INVENTION

In accordance with the present invention, a fluid transfer nozzle is provided that allows for one-step removal of a locking cap from an input port. The caps in question include a detent mechanism that is movable under the influence of a magnetic field from a locked position to an unlocked position. In the locked position of an example cap, the detent mechanism is drawn by the force of gravity into engagement with obstructions on the inside of the input port, which is typically oriented with the cap on top. That engagement inhibits rotation of the cap relative to the input port. The caps may also include a nut-shaped protrusion, typically from the top of the cap.

The fluid nozzle of the present invention has a socket that engages the cap in a manner that prevents relative angular movement between the socket and the cap. Preferably, the socket is located in the mouth of the nozzle, such that placing the nozzle mouth over the cap allows the socket to engage the nut-shaped obstruction of the cap. The nozzle also includes a magnetic element that, when the socket engages the cap, is in sufficiently close proximity to the detent mechanism to cause movement of the detent to the unlocked position. With the detent mechanism moved to the unlocked position, the nozzle may be rotated with the socket still engaged with the cap. This, in turn, rotates the cap to the point at which it may be removed from the input port. The nozzle is then replaced on the top of the input port, and the fluid product dispensed through it.

In the preferred embodiment, the fluid product is fuel oil and the input port is the input to a vertical pipe leading to a fuel oil tank. The input port includes a top region in which angular obstructions extend inward from an inner surface of the pipe, creating obstructions engaged by the detent mechanism in the locked position. The detent mechanism inside the cap can move vertically when in place on top of the input port, and falls into engagement with the obstructions under the force of gravity. The magnetic element is preferably a permanent magnet located in the mouth of the nozzle adjacent to the socket. The magnetic field of the permanent magnet is sufficient to lift the detent mechanism to the unlocked position when the socket engages the cap.

BRIEF DESCRIPTION OF THE DRAWINGS

The above and further advantages of the invention may be better understood by referring to the following description in conjunction with the accompanying drawings in which.

DETAILED DESCRIPTION

Figure 1:
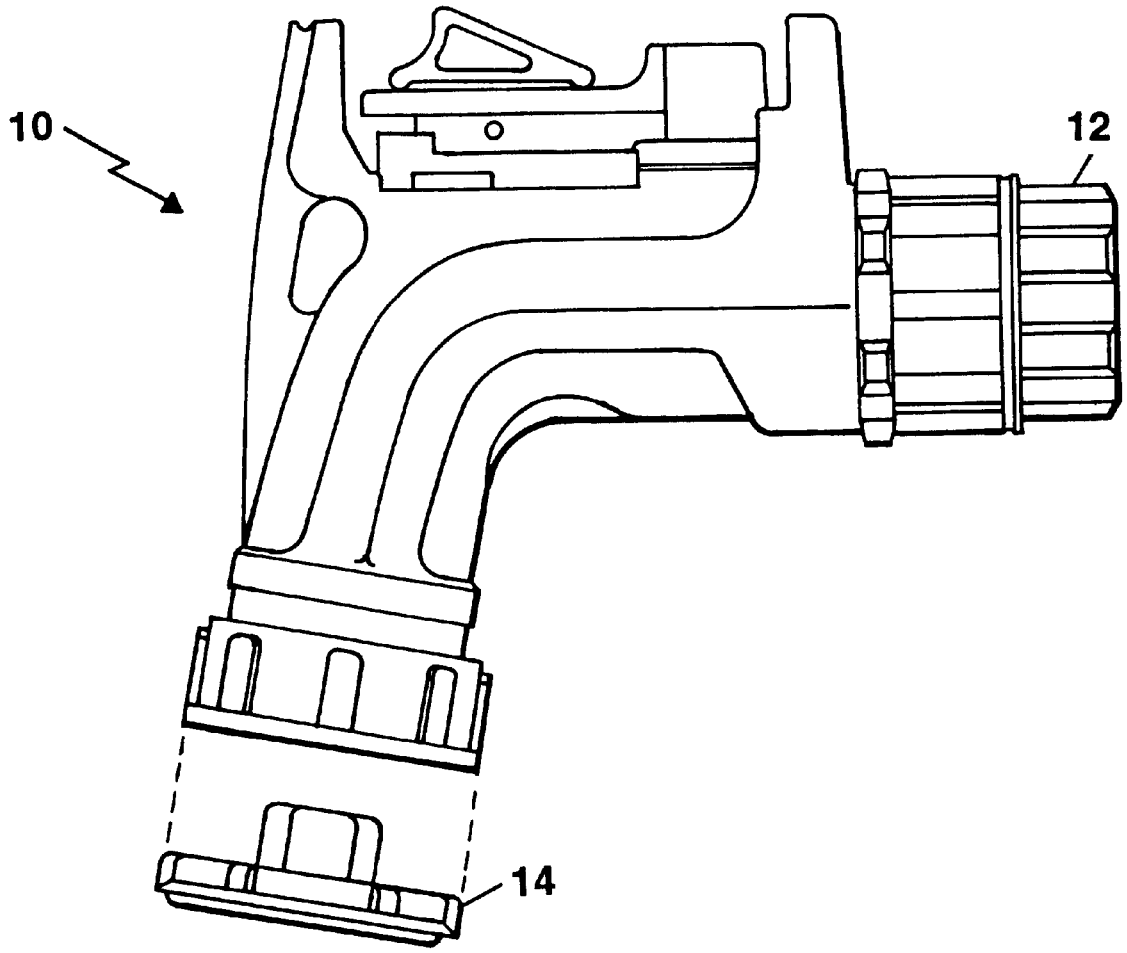
FIG. 1 is a side view of a fluid nozzle according to the present invention along with a representative input port cap.

Depicted in FIG. 1 is a fluid nozzle 10 that, in accordance with the present invention, has integrated within it a magnetic locking cap remover. The nozzle 10 has a coupling 12 to which a fluid hose is attached for providing the fluid, e.g., fuel oil, to the nozzle. Also shown in the figure is a magnetic locking cap 14 that might be sealing the top of a fluid pipe into which fluid is to be transferred. In the orientation shown, the nozzle 12 may be brought into contact with the cap, and rotated to correspondingly rotate the cap 14, simultaneously unlocking any magnetic lock that may be present.

Figure 2:
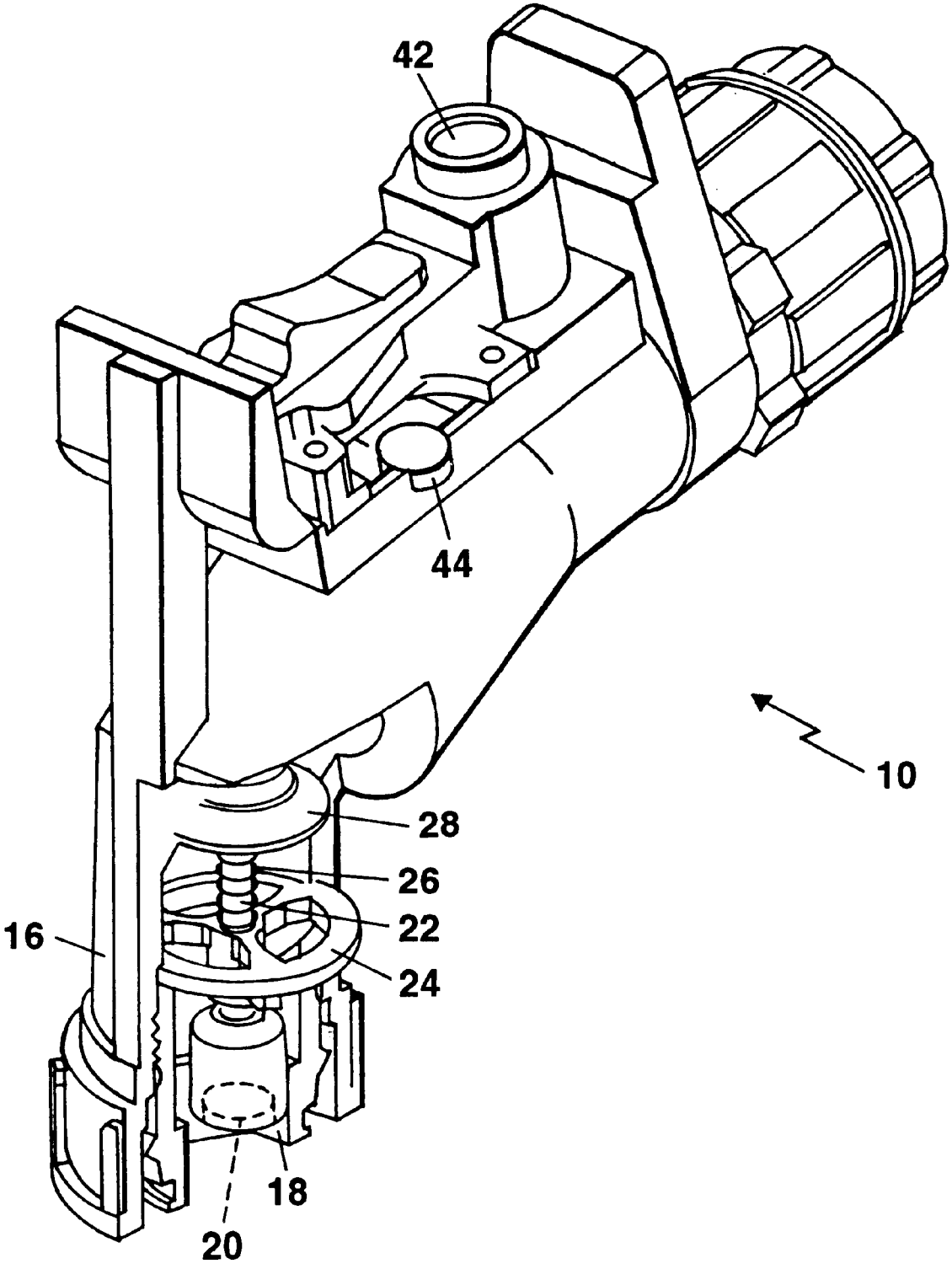
FIG. 2 is a perspective view of the nozzle of FIG. 1 partially cut away to show the interior of the nozzle mouth.

The fluid nozzle 10 is shown in FIG. 2 with its lower portion cut away. Within an outer fluid conduit 16 of the nozzle 10 is a socket 18 that engages a standard hexagonal nut on the top of the cap. This engagement prevents relative axial movement between the nozzle 10 and the cap 14 such that, when the nozzle is rotated, the cap 14 rotates with it. This allows a user to use the nozzle as a wrench to release a firmly tightened cap 14. Adjacent to the socket 18 is a magnetic element 20. The magnetic element 20 is mounted to a shaft 22 that is housed within a mounting bracket 24. The mounting bracket also functions as a flow baffle through which fluid flows. As shown, the shaft 22 is free to move parallel to the flow direction, but is biased by a coil spring 26 toward the position in which the magnetic element 20 resides adjacent to the mounting bracket 24. In this position, a sealing element 28 resides against a sealing surface within the nozzle, closing off the fluid conduit, thereby acting as a check valve. This prevents fluid within the nozzle, and any hose attached to it, from leaking out through the nozzle. When a pump for the fluid is engaged, the fluid pressure is sufficient to overcome the force of spring 26, thereby allowing fluid to flow out through the nozzle.

Figure 3:
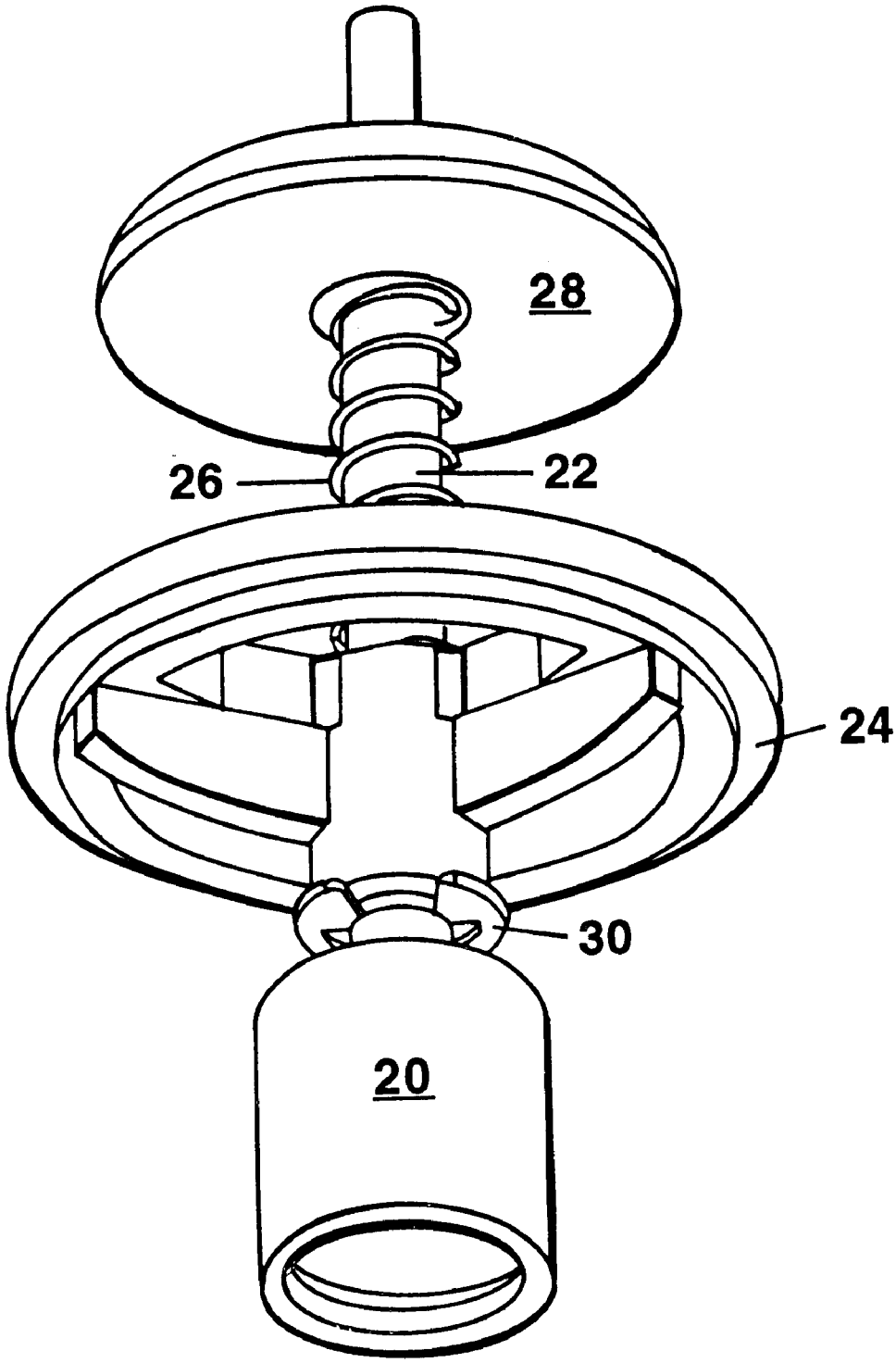
FIG. 3 is an isolated perspective view of an assembly within the mouth of the nozzle of FIG. 1, having a sealing surface, baffle and magnetic element mounted to a spring-biased shaft.

An isolated view of the assembly mounted to shaft 22 is shown in FIG. 3. The magnetic element 20 includes a permanent magnet located in an outer housing by which it is attached to the end of shaft 22. A retaining ring 30 resides in a groove on the shaft, and limits the travel of the shaft under the bias of spring 26. In the fully extended position, the sealing element 28 is in contact with the sealing surface of the nozzle 10.

Referring again to FIG. 2, when the outlet opening of the nozzle is lowered into place on a locking cap, such as cap 14 shown in FIG. 1, the detent mechanism is attracted by the magnetic element 20, removing the obstruction to the cap being rotated relative to the pipe. The nut (i.e., the hexagonal projection) on the cap is engaged by the socket 18 located on the inside of the nozzle. With the detent mechanism out of the way, the nozzle may then be rotated to loosen the cap as part of its removal. Further rotation may be done by hand, after which the cap is removed.

In contrast with prior art devices, the integrated nozzle and cap unlocking and removing mechanism prevents the possibility of separate tools getting lost. Since the nozzle is attached to the hose (which, in turn, is attached to the truck), it is never lost or misplaced. If separate tools to manipulate the cap or its locking mechanism, they could be accidentally left behind during a delivery, or lost for good. For example, if a delivery was being made when there was heavy snow on the ground, a separate tool could be dropped and lost in the snow. However, in the embodiment shown in FIGS. 13, no such separate tool is necessary.

Figure 4A:
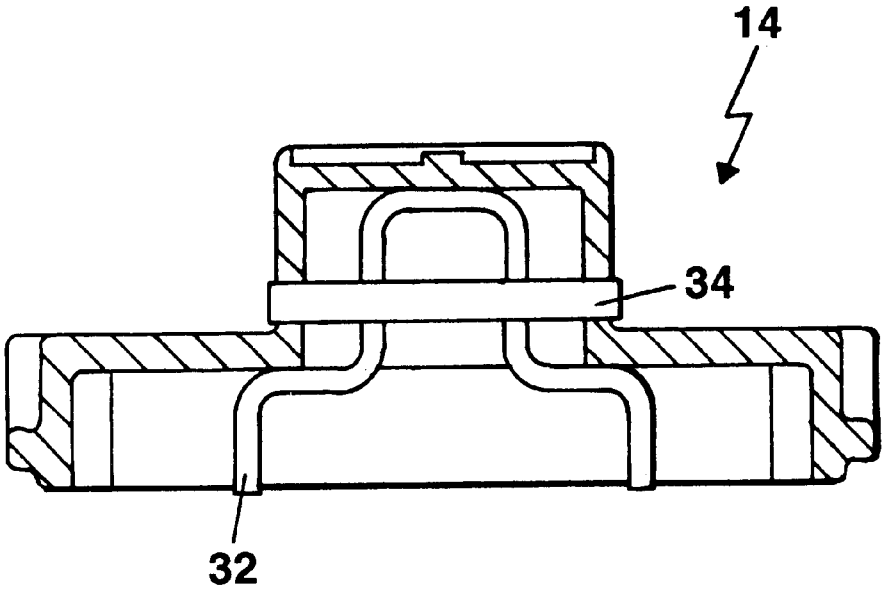
FIGS. 4A and 4B are cross-sectional views of a cap that may be used with the nozzle of FIG. 1, the two views being perpendicular to each other.
Figure 4B:
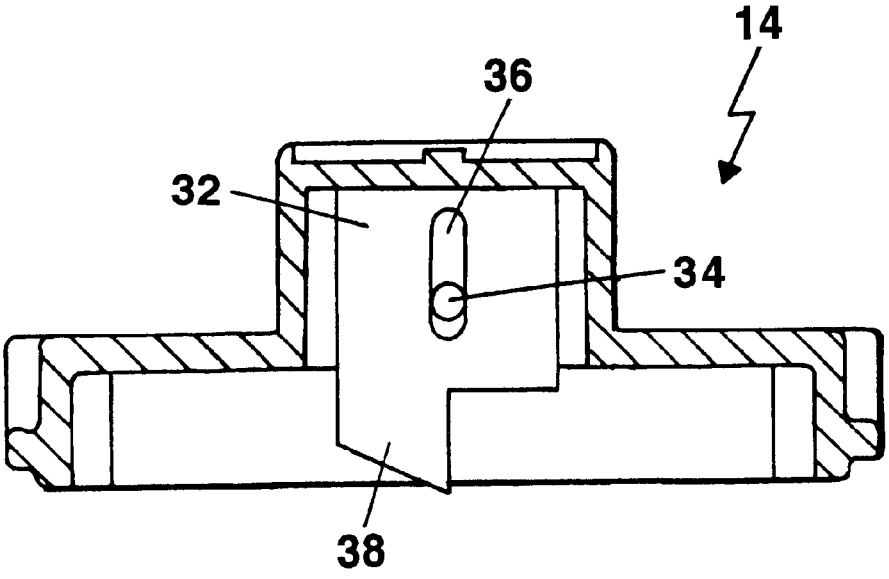

Although the nozzle of the present invention is intended to work with existing locking caps, a preferred locking cap is shown in FIGS. 4A and 4B. FIG. 4A is a first cross sectional view of locking cap 14, showing detent mechanism 32 in an unlocked position. As shown, detent mechanism 32 resides within the cap, with an upper portion extending to the top part of the cap. This shape allows the detent mechanism to be in close proximity to the region of the cap to which the magnetic element 20 of the nozzle will come the closest. The detent mechanism is retained in the cap by pin 34, which is rigidly secured to the cap 14 at both ends.

FIG. 4B is a second cross section of the cap, at a right angle to the view of FIG. 4A. As shown in FIG. 4B, the detent mechanism 32 has a slot 36 on either side through which the pin 34 extends. These slots 36 allow the detent mechanism 32 to slide up and down within the cap. Below each slot 36, the detent mechanism has a tapered extension 38. In the cross sectional view of FIG. 4B, only one of the slots 36 and extensions 38 are visible, but those skilled in the art will understand that the two sides of the detent mechanism are rotationally symmetric about an axis through the center of the cap perpendicular to the pin 34. Each of the extensions 38 of the detent mechanism can simultaneously engage the obstructions of a fill pipe outfitted for the locking cap. An example of the mouth of such a pipe is shown in FIG. 5.

Figure 5:
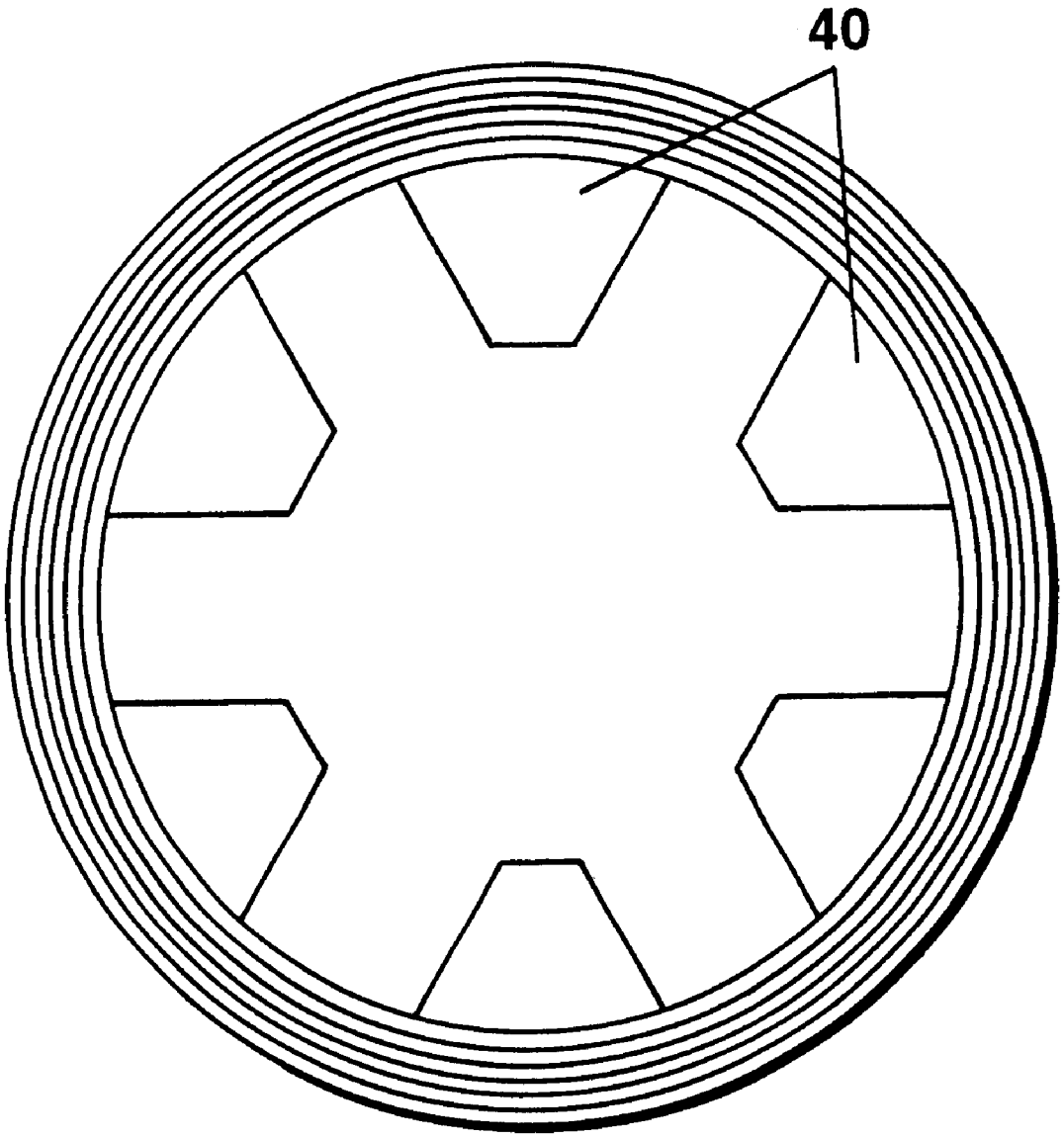
FIG. 5 is a schematic top view of an input port of a fluid pipe to which a cap such as that shown in FIGS. 4A and 4B may be attached.

FIG. 5 is a schematic view of the opening of a fuel oil fill pipe. The pipe is either itself intended to receive a locking cap, or has been outfitted with a collar intended for use with a locking cap. Such collars are known in the art, and connect to the fill pipe, for example, by screwing into screw threads on the inner surface of the pipe. The collar itself has a series of lugs 40 around its inner surface that extend inward in the mouth of the fill pipe. The gaps between adjacent lugs 40 provide spaces in which the extension 38 of the detent mechanism shown in FIGS. 4A and 4B can reside under the force of gravity. When in this position, counter-clockwise rotation of the cap is obstructed, thereby preventing its removal. With the application of the nozzle of the present invention to the cap, the magnetic element causes the detent mechanism, including the extensions 38, to lift up into the upper portion of the cap. In this position, the extensions are above the top level of the lugs 40, and the cap is thereby free to be rotated counter clockwise. In the preferred embodiment, the extensions 38 are tapered with an upper portion of the taper being above the level of the lugs 40 when the cap is in place. Thus, when the cap is being placed back onto the fill pipe by clockwise rotation, the contact between the lower surface of the extensions and the top of the lugs forces the detent mechanism upward and out of the way. Thus, the rotation of the cap is obstructed only in the counter-clockwise direction.

When the cap 14 is in place on the fill pipe, the nozzle 10 is applied to the top of the cap, such that the socket portion 18 of the nozzle engages the nut-shaped top portion of the cap (FIG. 2). The magnetic field of the magnetic element 20 causes the detent mechanism 32 to be drawn upward in the cap (FIGS. 4A and 4B) such that the extensions of the detent mechanism are lifted above the height of the lugs 40 (FIG. 5) of the collar in the fill pipe. The nozzle is then used to rotate the cap counter-clockwise. The length of the threads between the cap and the fill pipe/collar is short enough that, in the preferred embodiment, approximately a one third revolution of the cap is sufficient to allow it to be manually removed from the pipe. The nozzle 10 is then replaced on the fill pipe, and the liquid product pumped through the nozzle into the tank. Once filling is complete, the cap may be replaced by hand. It is rotated clockwise as the tapered edges of the extensions allow the detent mechanism 32 to slide over the lugs 40 of the collar until the cap is tight, and the extensions fall into two of the gaps between the lugs.

In the aforementioned embodiment of the nozzle 10, the magnetic element is described as being located within the mouth of the nozzle, as shown by element 20 of FIG. 2. However, it is also contemplated that a fixed magnetic element may be located elsewhere on the nozzle instead of, or in addition to, the magnetic element 20 in the nozzle. Such an element provides the benefit of being an integral part of the nozzle and, therefore, avoids the possibility of being lost or misplaced. There are numerous locations on the nozzle where such a magnetic element may be located, and each would provide the advantage of always being fixed to the nozzle. Two of the possible locations for such a magnetic element are also shown in FIG. 2. Permanent magnetic 42 may be located atop a nozzle flow controller. Similarly, permanent magnet 44 may be located adjacent to and below the flow controller. Both of these magnet locations and, indeed, others as well that are not specifically described herein, allow a user to extend the region of the nozzle containing the magnetic element in question toward the top of a locking cap. When the magnetic element 42 or 44 is in close enough proximity to the detent mechanism within the cap, the detent mechanism moves to the unlocked position, and the cap may be removed manually. If the cap is on too tight to be removed manually, the socket portion 18 of the nozzle may be used to loosen the cap until the detent mechanism is encountered. This should result in the cap being loose enough for manual removal. The magnetic element (42 or 44) that is being used is then brought into proximity to the cap so as to move the detent mechanism to the unlocked position, and the cap is removed by hand.

While the invention has been shown and described with reference to a preferred embodiment thereof, those skilled in the art will recognize that various changes in form and detail may be made herein without departing from the spirit and scope of the invention as defined by the appended claims.

What is claimed is:

1. A fluid transfer nozzle for delivering a fluid product to an input port having a cap with a detent mechanism that is movable under the influence of a magnetic field from a locked position, in which rotation of the cap relative to the input port is inhibited, to an unlocked position, in which rotation of the cap is enabled, the nozzle comprising:

a socket that engages the cap in a manner that prevents relative angular movement between the socket and cap; and a magnetic element that is an integral part of the nozzle and that, when placed in sufficiently close proximity to the detent mechanism, causes movement of the detent mechanism to the unlocked position.

2. A nozzle according to claim 1 wherein the magnetic element is embedded in a surface of the nozzle.

3. A nozzle according to claim 1 wherein the magnetic element comprises a permanent magnet.

4. A nozzle according to claim 1 wherein the magnetic element is located to a side of the nozzle opposite a nozzle mouth through which fluid flows.

5. A nozzle according to claim 1 wherein the cap may typically be loosened by manual rotation.

6. A fluid transfer nozzle for delivering a fluid product to an input port having a cap with a detent mechanism that is movable under the influence of a magnetic field from a locked position, in which rotation of the cap relative to the input port is inhibited, to an unlocked position, in which rotation of the cap is enabled, the nozzle comprising:

a socket that engages the cap in a manner that prevents relative angular movement between the socket and cap; and a magnetic element that, when the socket engages the cap, is in sufficiently close proximity to the detent mechanism to cause movement of the detent mechanism to the unlocked position.

7. A nozzle according to claim 6 wherein the cap comprises a nut-shaped protrusion that is engaged by the socket.

8. A nozzle according to claim 6 wherein the magnetic element comprises a permanent magnet adjacent to the socket.

9. A nozzle according to claim 6 wherein the fluid product comprises fuel oil.

10. A nozzle according to claim 6 wherein the input port is a pipe having an obstruction, and wherein the detent mechanism engages the obstruction when it is in the locked position.

11. A nozzle according to claim 6 wherein the input port is at the top of a vertical pipe, and wherein the detent mechanism is normally retained in the locked position by force of gravity.

12. A nozzle according to claim 6 wherein the socket and the magnetic element both reside within a mouth of the nozzle.

13. A fluid transfer nozzle for delivering a fluid product to an input port having a cap with a detent mechanism that is movable under the influence of a magnetic field from a locked position, in which rotation of the cap relative to the input port is inhibited by contact of the detent mechanism with an obstruction in the input port, to an unlocked position, in which rotation of the cap is enabled, the cap further having a nut-shaped protrusion, the nozzle comprising:

a socket located in a mouth of the nozzle that engages the nut-shaped protrusion of the cap in a manner that prevents relative angular movement between the socket and cap, thereby allowing the cap toe rotated by rotating the nozzle; and a magnetic element located in the nozzle mouth that, when the socket engages the cap, is in sufficiently close proximity to the detent mechanism to cause movement of the detent mechanism against the force of gravity to the unlocked position.

14. A method for delivering a fluid product with a nozzle to an input port having a cap with a detent mechanism that is movable under the influence of a magnetic field from a locked position, in which rotation of the cap relative to the input port is inhibited, to an unlocked position, in which rotation of the cap is enabled, the method comprising:

unlocking the cap with a magnetic element that is an integral part of the nozzle and that, when placed in sufficiently close proximity to the detent mechanism, causes movement of the detent mechanism to the unlocked position;

engaging the cap with a socket of the nozzle in a manner that prevents relative angular movement between the socket and cap and rotating the nozzle while engaged with the cap so as to rotate the cap to a position in which it may be removed; and dispensing fluid through the nozzle to the input port.

15. A method according to claim 14 wherein the magnetic element is embedded in a surface of the nozzle.

16. A method according to claim 14 wherein the magnetic element comprises a permanent magnet.

17. A method according to claim 14 wherein the magnetic element is located to a side of the nozzle opposite a nozzle mouth through which fluid flows.

18. A method according to claim 14 wherein the cap may typically be loosened by manual rotation.

19. A method for delivering a fluid product with a nozzle to an input port having a cap with a detent mechanism that is movable under the influence of a magnetic field from a locked position, in which rotation of the cap relative to the input port is inhibited, to an unlocked position, in which rotation of the cap is enabled, the method comprising:

engaging the cap with a socket of the nozzle in a manner that prevents relative angular movement between the socket and cap;

unlocking the cap with a magnetic element that, when the socket engages the cap, is in sufficiently close proximity to the detent mechanism to cause movement of the detent mechanism to the unlocked position;

rotating the nozzle while engaged with the cap so as to rotate the cap to a position in which it may be removed; and dispensing fluid through the nozzle to the input port.

20. A method according to claim 19 wherein the cap comprises a nut-shaped protrusion that is engaged by the socket.

21. A method according to claim 19 wherein the magnetic element comprises a permanent magnet adjacent to the socket.

22. A method according to claim 19 wherein the fluid product comprises fuel oil.

23. A method according to claim 19 wherein the input port is a pipe having an obstruction, and wherein the detent mechanism engages the obstruction when it is in the locked position.

24. A method according to claim 19 wherein the input port is at the top of a vertical pipe, and wherein the detent mechanism is normally retained in the locked position by force of gravity.

25. A method according to claim 19 wherein the socket and the magnetic element both reside within a mouth of the nozzle.

26. A method for delivering a fluid product with a nozzle to an input port having a cap with a detent mechanism that is movable under the influence of a magnetic field from a locked position, in which rotation of the cap relative to the input port is inhibited by contact of the detent mechanism with an obstruction in the input port, to an unlocked position, in which rotation of the cap is enabled, the cap further having a nut-shaped protrusion, the method comprising:

engaging the nut-shaped protrusion of the cap with a socket located in a mouth of the nozzle in a manner that prevents relative angular movement between the socket and cap;

unlocking the cap with a magnetic element located in the nozzle mouth that, when the socket engages the cap, is in sufficiently close proximity to the detent mechanism to cause movement of the detent mechanism against the force of gravity to the unlocked position;

rotating the nozzle while engaged with the cap so as to rotate the cap to a position in which it may be removed; and dispensing fluid through the nozzle to the input port.

* * * * *